United States Patent [19]

Gallagher et al.

[11] 4,290,370

[45] Sep. 22, 1981

[54] STACKABLE PALLET ASSEMBLY

[75] Inventors: Ronald M. Gallagher; Michael E. Nadler; Charles E. Highsmith, all of Springfield; Richard L. Minchey, Nashville, all of Tenn.

[73] Assignee: Unarco Industries, Inc., Chicago, Ill.

[21] Appl. No.: 853,418

[22] Filed: Nov. 21, 1977

[51] Int. Cl.[3] ..... B65D 19/28

[52] U.S. Cl. ..... 108/53.5; 108/51.1; 108/55.1

[58] Field of Search ..... 108/53.5, 55.1, 55.3, 108/51.1-54.1, 56.1-57.1, 55.5, 29-31; 211/23, 24, 194, 204; 214/10.5 R; 206/304, 600, 599, 386; 403/19, 20, 361, 367-369, 374; 52/473, 660, 670

[56] References Cited

U.S. PATENT DOCUMENTS

| | | | |
|---|---|---|---|
| 651,642 | 6/1900 | White | 52/670 |
| 894,250 | 7/1908 | Woods | 403/19 X |
| 1,494,823 | 5/1924 | Tappen | 52/660 X |
| 1,902,751 | 3/1933 | Bauman | 403/19 X |
| 2,406,557 | 8/1946 | Nagin | 52/670 |
| 2,700,520 | 1/1955 | Skabic | 108/53.5 |
| 2,941,772 | 6/1960 | Thayer et al. | 108/53.1 |
| 3,147,864 | 9/1964 | Sylvester | 211/24 |
| 3,221,636 | 12/1965 | Smith et al. | 52/473 X |
| 3,400,671 | 9/1968 | Erismann | 108/53.5 |
| 3,672,515 | 6/1972 | Rons | 108/53.1 X |
| 3,812,974 | 5/1974 | Sylvester | 211/23 |
| 3,935,948 | 2/1976 | Podojil | 211/23 |
| 4,032,165 | 6/1977 | Russell | 211/204 X |
| 4,056,195 | 11/1977 | Keith | 108/51.1 X |

FOREIGN PATENT DOCUMENTS

| | | | |
|---|---|---|---|
| 535642 | 1/1957 | Canada | 108/53.5 |
| 1040965 | 10/1958 | Fed. Rep. of Germany | 108/53.5 |

*Primary Examiner*—William E. Lyddane
*Attorney, Agent, or Firm*—Clement and Ryan

[57] ABSTRACT

A pallet assembly having upright posts that accommodate stacking under load conditions and are removable for storage. The posts are each rigidly held by a post-supporting assembly that has at least one wedge and a post-receiving socket. Each socket has an access opening for insertion of a post-release bar to facilitate removal of the posts.

18 Claims, 12 Drawing Figures

26a
26e
106
26c
26d
26
26b
26f
22
34
20
24
72
106
26
62
72
62
24
72

26
66
62
64
72
96
32
68
74
102
100
70
98

306
289
293
295
293
291

66
62
64

78
74
96
76
68
78
78
72
78
102
70

STACKABLE PALLET ASSEMBLY

BACKGROUND OF THE INVENTION

This invention relates to pallets, and more particularly, to pallet assemblies having upright posts connected thereto.

Some types of pallet assemblies utilize posts to accommodate stacking of the pallet under load conditions and/or to assist in deterring longitudinal and lateral shifting of the load.

The posts of some of these conventional pallet assemblies, however, may sometimes wobble or shift under various load conditions and/or be staggered and slanted at different angles relative to the pallet so as to have different effective heights. This type of construction and arrangement may interfere with the load-carrying capacity of the pallet, particularly if the posts are slanted inwardly over the pallet. Moreover, stacking of these conventional pallet assemblies under load conditions may not be uniform and stable, especially if the posts wobble or are at different effective heights, which might cause the pallet assemblies to tip over or even collapse creating a potentially unsafe and hazardous condition. Furthermore, in some conventional pallet assemblies, the posts cannot be readily removed for compact storage.

It is therefore desirable to provide an improved pallet assembly which overcomes most, if not all, of these problems.

SUMMARY OF THE INVENTION

A pallet assembly is provided with posts which are rigidly secured to the pallet at uniform heights to provide stable and uniform stacking under load conditions. Advantageously, the posts can be readily removed from the pallet to permit compact storage of both the pallet and the posts.

In accordance with principles of the present invention the stackable pallet assembly includes a post-supporting assembly to support each post. Desirably, the post-supporting assembly includes an elongated upright socket for telescopically receiving the post and a wedge for wedgingly engaging the post. In the preferred form, each post has a hollow bottom end portion at its bottom end and the wedge extends into the interior of the socket for interlockingly engaging and rigidly supporting the hollow bottom end portion of the post.

In order to accommodate removal of each post, each of the sockets has an access opening that generally faces outwardly. A lever or post release bar is insertable into the access opening for prying the post away from the wedge. In the illustrative embodiment the bottom of each socket is connected to a nestable truncated support member with outwardly flared side walls. Preferably, the upper edge portion of the side walls adjacent the access opening provides a fulcrum for the lever.

In one of the embodiments the stackable pallet assembly includes a pair of spaced end posts and a beam extending between and connecting the end posts to substantially prevent the end posts from bending under load. At least one bracket assembly is connected to one of the posts with the bracket assembly having at least one load-carrying arm.

When the stackable pallet assembly is used for carrying tires in a railway car, the pallet assembly preferably includes three bracket assemblies extending outwardly from each end post. Each bracket assembly includes a bracket support connected to the post and an intermediate supporting arm extending outwardly of the bracket support. A connector is attached to one end of the intermediate support arm for removably connecting the intermediate support arm to the bracket support, and a transverse bar is attached to the other end of the intermediate support arm. A pair of tire-carrying arms are centilevered from the transverse bar and extend inwardly towards the opposite end of the pallet.

Preferably, the minimum distance between each of the tire-carrying arms and the posts is greater than the maximum radius of the tire to be carried on the arms. The bracket assemblies are vertically spaced from each other and are constructed and arranged so that the minimum vertical spacing between the tire-carrying arms of adjacent bracket assemblies is greater than the maximum diameter of the tires to be carried on the arms.

A more detailed explanation of the invention is provided in the following description and appended claims taken in conjunction with the accompanying drawings.

DETAILED DESCRIPTION OF THE ILLUSTRATIVE EMBODIMENT

Figure 1:
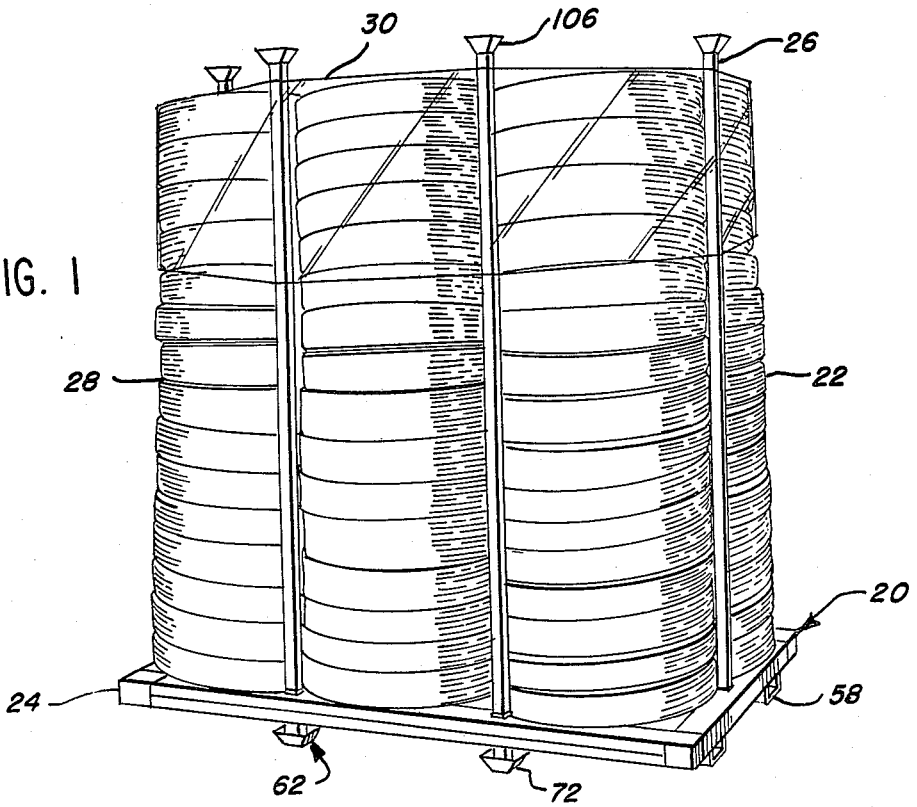
FIG. 1 is a perspective view of the stackable pallet assembly in accordance with principles of the present invention with columns of stacked tires loaded thereon.

FIGS. 1–9 of the drawings illustrate a stackable pallet assembly 20 for carrying various types of products. The stackable pallet assembly 20 is particularly useful for carrying columns of stacked tires 22 for use in warehouses, factories, service centers, etc. and for shipment in trucks and the like. In the illustrative embodiment, six columns of tires 22 can be stacked upon the pallet 24. It is to be understood, however, that the load-carrying capacity of the pallet 24 can be increased, if desired, by increasing the surface area of the pallet.

Stackable pallet assembly 20 has a plurality of elongated posts 26 (which are at a predetermined desired uniform length) extending upwardly from the pallet 24 to assist in detering longitudinal and lateral shifting of the load. Posts 26 of the appropriate predetermined lengths accommodate stacking of the pallet 24 under load conditions (as shown in the right-hand portions of FIG. 3) and are removable to permit generally compact storage of both the pallet 24 and the posts 26 (as shown in the left-hand portion of FIG. 3). In the illustrative embodiment the minimum spacing between adjacent posts 26 is greater than the maximum outside diameter of any one tire 22 to permit ready insertion and removal of the tires 22 from the pallet 24.

Corrugated cardboard dividers or other sheet-like material 28 (FIG. 1) can be staggered between the various stacked tires 22 to minimize slippage of the stacked tires. Wrapping material 30, such as polyvinyl chloride stretch wrap, can be wrapped around at least the upper portion of the outer edges of the posts 26 to minimize longitudinal and lateral shifting of the tires 22.

Each of the posts 26 desirably has a hollow lower portion 32 (FIG. 5) at its bottom end. Preferably, the posts 26 are each tubular and rectangular in cross-section. In some circumstances, however, it may be desirable that the posts have a different cross-sectional configuration.

Figure 2:
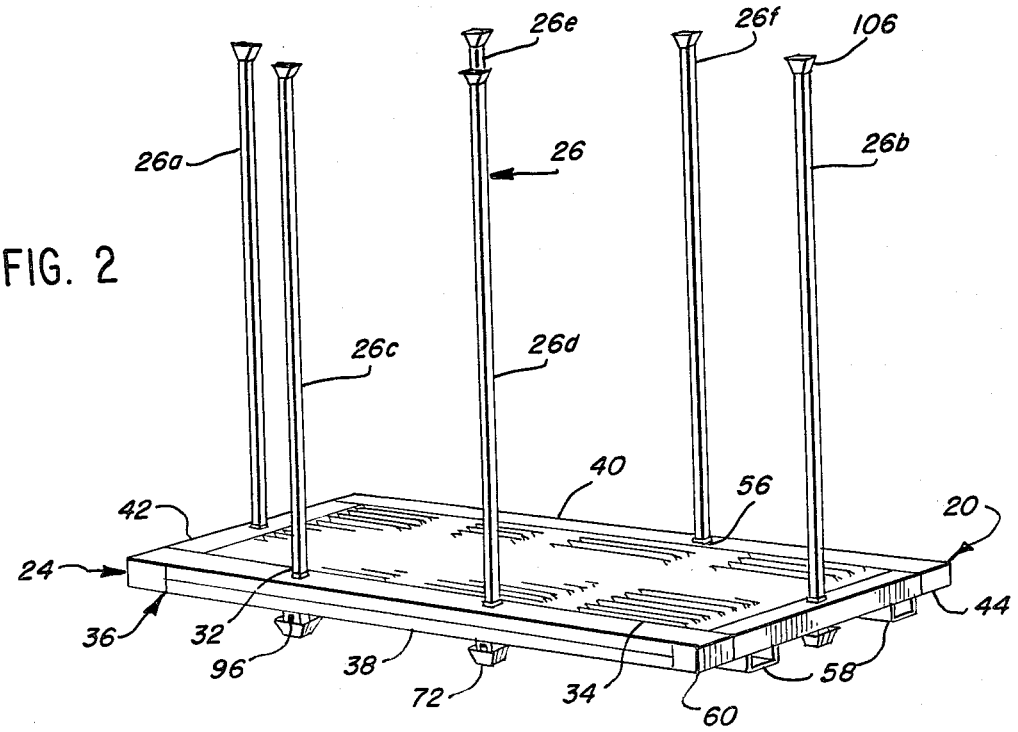
FIG. 2 is a perspective view of the stackable pallet assembly without the tires loaded thereon.

In the illustrative embodiment there are six posts 26, as best shown in FIG. 2, including a first end post 26*a* positioned adjacent one end 42 of the pallet 24, a second end post 26*b* positioned adjacent the other end 44 of the pallet 24, a first set of spaced apart posts 26*c* and 26*d* positioned adjacent one side 38 of the pallet 24 as well as positioned intermediate and between the first and second end posts 26*a* and 26*b*, and a second set of spaced apart posts 26*e* and 26*f* similarly positioned adjacent the opposite side 40 of the pallet 24.

Figure 3:
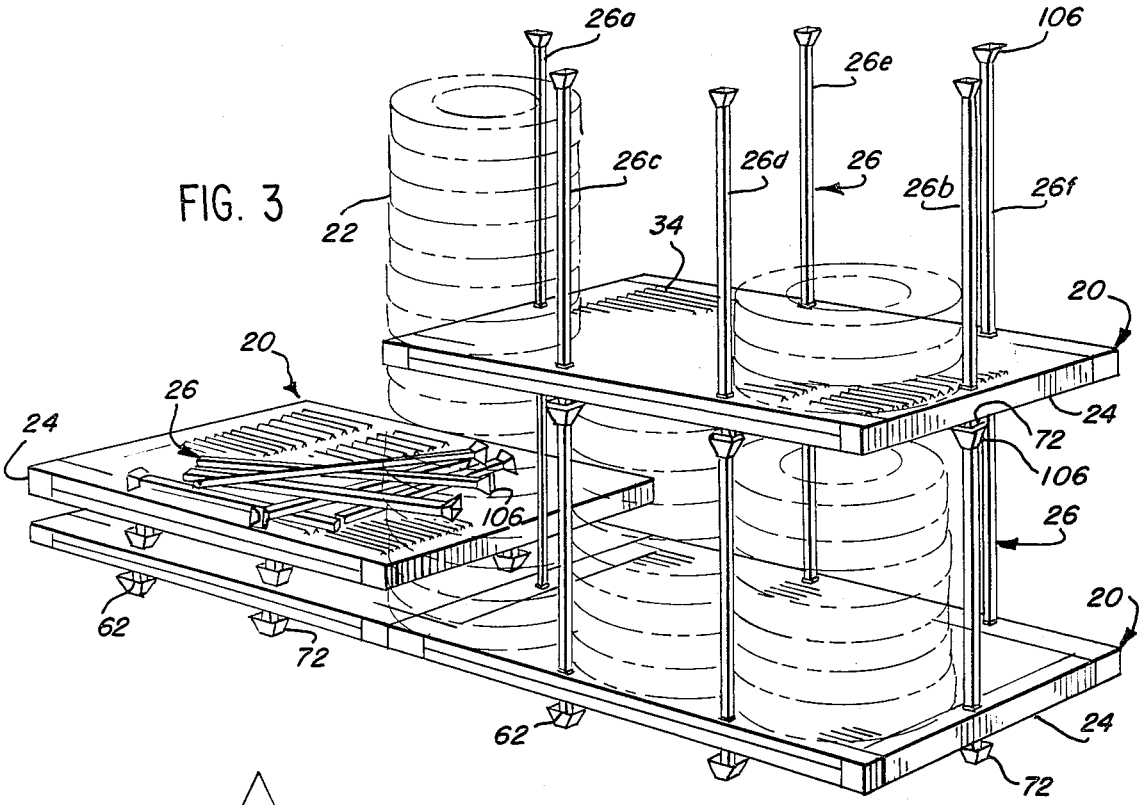
FIG. 3 is a perspective view of two pallet assemblies stacked upon each other during load conditions and two stacked pallets with their posts removed for storage.
Figure 5:
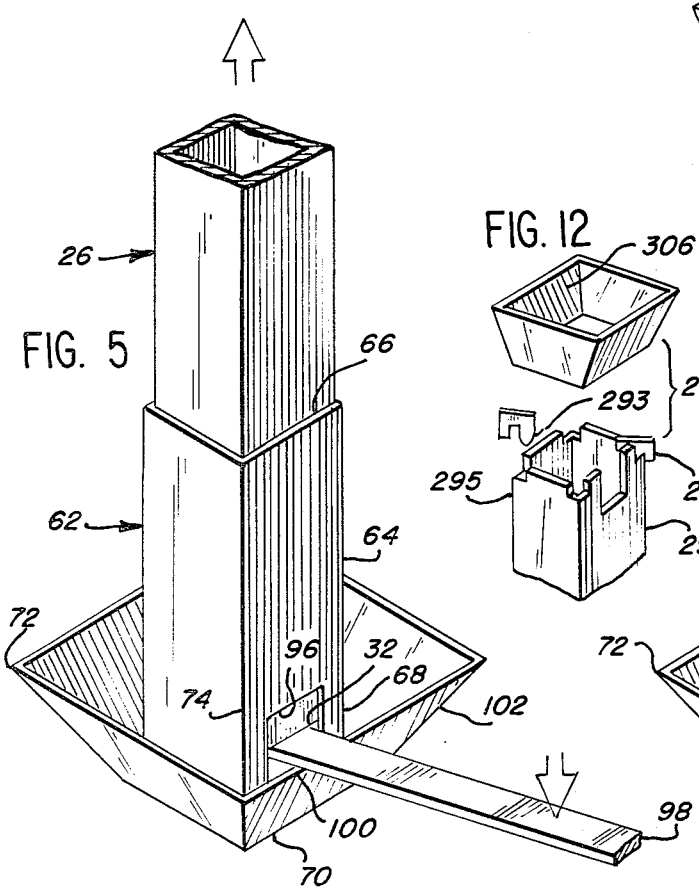
FIG. 5 is a perspective view of the post-supporting assembly with a lever inserted therein to facilitate removal of the post.
Figure 9:
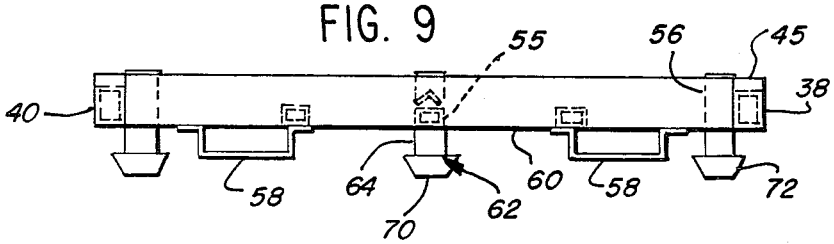
FIG. 9 is an end view of the pallet taken substantially along line 9—9 of FIG. 7.

The pallet 24 has an upper load-supporting surface 34 for supporting columns of tires 22 or other products. Upper load-support surface 34 preferably takes the form of a louvered deck or panel having louvered portions providing a louvered shaped thickness, as best shown in FIGS. 2 and 3, for enhancing the load-supporting surface's strength. A pallet frame or understructure 36 supports the louvered deck. Frame 36 has opposed sides 38 and 40 and ends 42 and 44 extending between and connecting the sides. Corner angles or angled face plates 45 (FIGS. 7–9) are connected to the outer corners of ends 42 and 44 so as to cover the open sidewise ends thereof. Intermediate longitudinal support angles 46 (FIG. 7) are positioned between the opposed sides 38 and 40 and are connected to the end post-support assemblies 62 and abuts against intermediate transverse support angles 48. The intermediate transverse support angles 48 connect the sides 38 and 40 to provide additional support for the louvered deck. In the illustrative embodiment, the intermediate transverse support angles 48 have a corner 51 that bears against and supportingly engages the underside of the louvered deck. Frame 36 also has intermediate transverse braces or support bars 52 connecting sides 38 and 40, and has intermediate longitudinal braces or support bars 54, which connect the transverse bars 52, for allowing four way entry and engagement of the tines of a forklift truck. Auxiliary tubes 55 bear against and support the end post-supporting assemblies 62 as shown in FIG. 9.

Preferably, the pallet 24 defines a plurality of upwardly facing openings or holes 56 (FIG. 7), one of which is associated with each post 26. The pallet 24 can also include a pair of longitudinal tine-receiving and support guides 58 (FIGS. 2 and 9) that extend downwardly from the underside 60 of the pallet 24 to receive the tines of a forklift truck.

In order to securely and rigidly support the posts 26 in an upright position a post-supporting assembly 62 is securely carried by the pallet 24 about each opening 56. Post-supporting assembly 62 includes an elongated socket 64 that extends upwardly through the upwardly facing opening 56 and is welded to the frame 36. Socket 64 has interior walls 66 (FIGS. 4 and 5) which are shaped complementary and have a slightly greater cross-sectional area than the outer periphery of the associated post 26 to telescopically receive the associated post 26. In the illustrative embodiment, socket 64 is tubular and rectangular in cross-section and extends below the underside 60 of the pallet. The top of the socket 64 (FIG. 8) preferably is positioned slightly above the louvered deck 34 to provide a surface for welding to the frame 36.

Although the described arrangement is preferred, in some circumstances it may be desirable to connect the sockets 64 to the outside of the frame.

The lower end portion 68 (FIG. 4) of the socket 64 is supported on and welded to a base portion or base 70 of a lower first nestable truncated support member or cup 72. Desirably, the four corners 74 of the lower end portion 62 of the rectangular socket 64 each define a locking ear-receiving slot 76 adjacent the base 70.

In order to securely, but releasably, connect the associated post 26 to the socket 64, a locking ear 78 is positioned in each of the ear-receiving slots 76 of the socket 64. In detail, each locking ear 78 (FIG. 6) has a U-shaped channel or groove 80 which engages against the walls of the socket 64 defining the ear-receiving slot 76. The locking ear 78 has a tab-like tail 82 that extends outwardly of the corner 74 of the socket 64 to provide a welding surface for connection to the base 70 and/or inner wall surfaces of the lower nestable support member or cup 72. The bottom 83 of the locking ear is generally straight and flat and is seated upon and secured to the base 70 of the lower nestable support member 72.

The inwardly facing side 84 of the locking ear 78 has an upright lower portion 86 and an upper arcuate or curved portion 88 that extends upwardly within the interior of the socket 64 towards the associated corner 74 of the socket 64. Curved portion 88 terminates in an apex 90.

In accordance with principles of the present invention, locking ear 78 has an upwardly inclined bearing surface 92 that extends between and connects the U-shaped channel 80 and the apex 90. The upwardly inclined bearing surface 92 has an elongated lower portion 92*a* that forms a wedge and an upper portion 92*b*. Wedge 92*a* is also positioned within the interior of the socket and projects upwardly at an acute angle relative to the vertical, such as at about 15 degrees, towards an opposite corner 74 of the socket 64. Desirably, the upper portion 92*b* of the upwardly inclined bearing surface 92 is tapered slightly inwardly and at a greater angle to the vertical than the lower portion 92*a* for ease of entry of the associated post 26 upon the wedge 92*a*.

Wedge 92*a* cooperates with the interior walls 66 of the socket 64 to define a wedge pocket 94 therebetween. The wedge 92*a* and the interior walls 66 of the socket 64 which together define the wedge pocket 94, firmly wedge against and interlockingly engage the lower bottom end portion 32 (FIG. 5) of the post 26, when the post 26 is inserted in the socket 64, to rigidly support the post 26 in an upright position. The weight of the post 26 also contributes to the wedging connection of the wedge pocket 94.

Preferably, wedge pocket 94 of each of the post-supporting assemblies 64 are constructed and arranged similarly so that all posts 26 are positioned at a generally uniform angle relative to the upper load-supporting surface 34 (FIG. 2) of the pallet 24. This arrangement assures that the posts 26 are positioned at uniform heights so as to provide stable stacking of adjacent pallet assemblies under load conditions as shown in the right hand portion of FIG. 3. Most preferably, each wedge pocket 94 supports its associated post 26 in a vertical position substantially perpendicular to the upper load-supporting surface 34 of the pallet 24.

In order to release and remove the posts 26 from the wedge pocket 94 and the post-supporting assembly 62, the lower bottom end portion 68 of the socket 64 defines an access opening 96 (FIGS. 4 and 5) that faces outwardly. In the illustrated embodiment the access opening 96 is an inverted U-shaped hole that extends from a position adjacent the base 70 to a position above the truncated support member 72. An elongated lever of post-release bar 98, such as a crowbar, is insertable in the access opening 96 to pryingly engage and release the bottom edges of the associated post 26 from its interlocking position in the wedge pocket 94 to permit removal of the associated post 26. Desirably, the upper edge 100 of the truncated support member 72, located adjacent the access opening 96, provides a fulcrum for the lever 98.

In order to facilitate stacking of the pallet 24 as best shown in FIG. 3, the lower nestable support members or cups 72 each have outwardly flared side walls 102 (FIGS. 4 and 5) that extend upwardly from the base 70. In the illustrative embodiment, base 70 is rectangular and generally planar and the nestable support member or cup 72 takes the form of a frustum of a right rectangular pyramid.

The upper end of each post 26 has an upper second nestable truncated support member or cup 106 mounted thereon. The upper nestable cup 106 is similar in size and shape to the bottom cups 72, but with its base secured to the top edges of the post. During stacking, as shown in the right-hand portion of FIG. 3, the upper truncated support member or cup 106 of one pallet assembly 20 nestably receives and supports the lower truncated support member or cup 72 of another pallet assembly.

Figure 10:
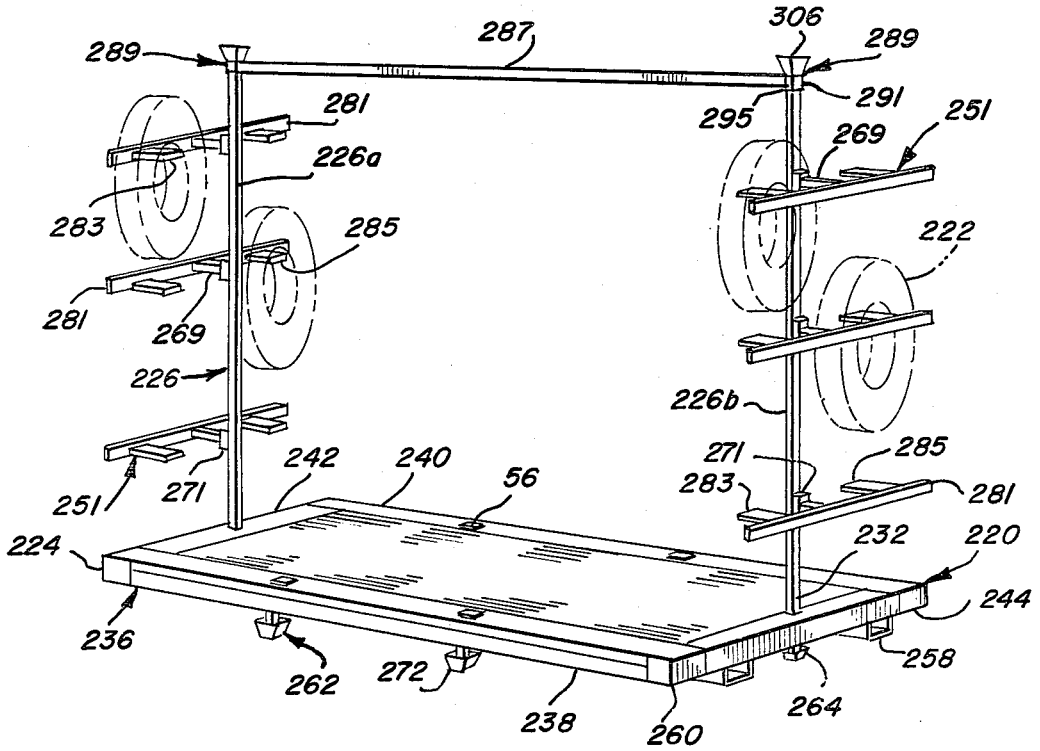
FIG. 10 is a perspective view of another embodiment of the stackable pallet assembly in accordance with principles of the present invention.

FIG. 10 illustrates another embodiment of a stackable pallet assembly 220, but with its side posts removed. Stackable pallet assembly 220 is particularly useful for carrying tires 222 and other products in a railway car. The pallet 224, posts 226, post-supporting assemblies 262, and lower truncated support members 272 of the embodiment shown in FIGS. 10 is substantially similar to the posts 26, pallet 24, post-supporting assemblies 62, and lower truncated support members 72 of the pallet assembly 20 shown in FIGS. 1-8. For ease of understanding and comparison, similar parts and components of the pallet assembly 220 in FIG. 10 have been given numbers similar to the corresponding parts and components of the pallet assembly 20 of FIGS. 1-9, but increased by an amount of 200, such as posts 226, frame 236, etc.

Stackable pallet assembly 220 also has three bracket assemblies 251 which extend outwardly from each end post 226*a* and 226*b*. Bracket assemblies 251 provide auxiliary support means for carrying additional tires 222 in an upright position.

Figure 11:
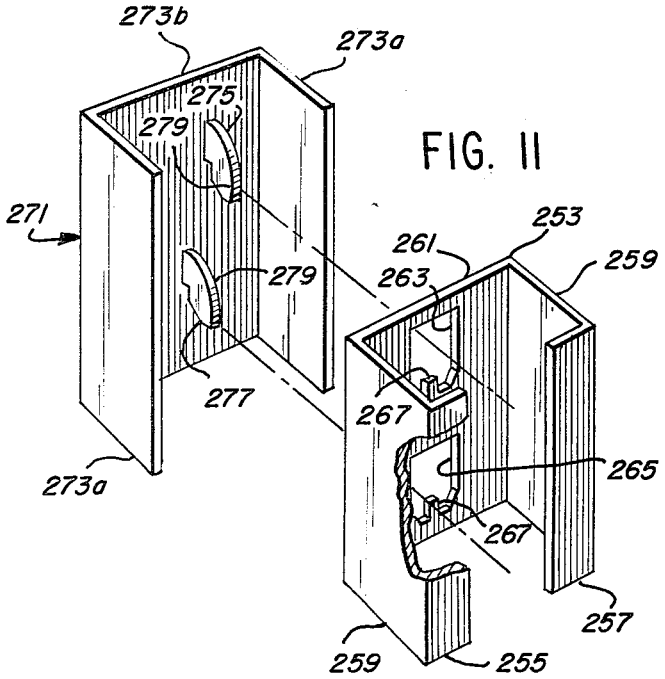
FIG. 11 is an enlarged perspective view of a connector and bracket support.
Figure 6:
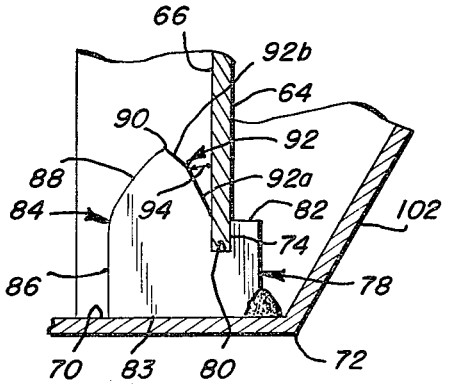
FIG. 6, shown on the fourth sheet of the drawings, is a greatly enlarged side view of a locking ear and certain elements associated therewith shown in fragmentary sectional views.
Figure 7:
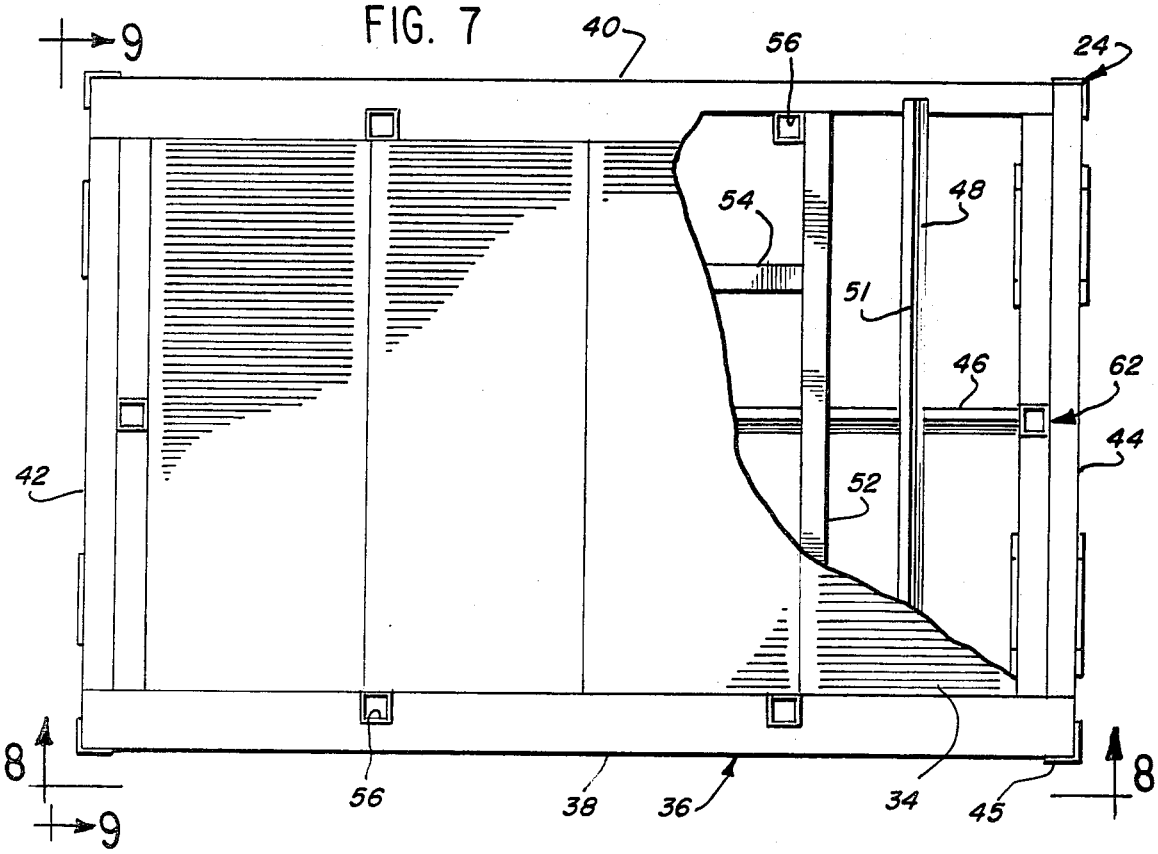
FIG. 7, shown on the third sheet of drawings, is a top plan view of the pallet with parts broken away for purposes of illustration.
Figure 8:
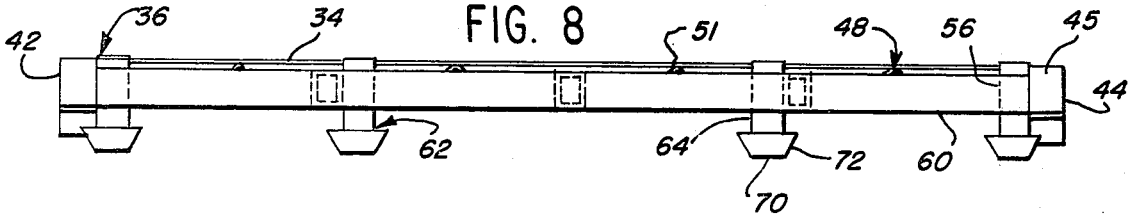
FIG. 8 is a side view of the pallet taken substantially along line 8—8 of FIG. 7.

Each of the bracket assemblies 251 has an upright channel-shaped bracket support 253 (FIG. 11) with upright back surfaces 255 and 257 that are spaced apart and are welded to the outer face of an associated end post 226*a* or 226*b*. A pair of intermediate side members 259 connect the front face 261 of the bracket support 253 to the back surfaces 255 and 257 and space the front face 261 outwardly and away from the outer face of the associated end post 226*a* or 226*b*. Front face 261 defines upper and lower openings or apertures 263 and 265, respectively. Openings 263 and 265 are preferably in vertical alignment with each other and are of the same size and shape. In the illustrative embodiment, the lower end of each opening 263 and 265 is W-shaped and the walls defining the lower end of the opening 263 and 265 provide an upwardly extending support member or tooth 267.

Each bracket assembly 251 also has an elongated intermediate support arm 269 (FIG. 10) that extends outwardly and generally horizontally of the associated end post 226*a* or 226*b*. One end of the support arm 269 has a U-shaped connector 271 (FIG. 11) with opposed side walls 273*a* having an upright intermediate wall 273*b* that generally faces the front face 261 of the bracket support 253. A pair of fingers 275 and 277 extend inwardly and hook downwardly from the upright wall 273*b*. Each hooked finger 275 or 277 has an inner upright side surface 279 which bears against one side of the upwardly extending support member or tooth 267. Fingers 275 and 277 are insertable in the upper and lower openings 263 and 265, respectively, and are hooked upon and supported by the bracket support 253 for effecting a releasable connection between the support arm 269 and the bracket support 253. In the illustrative embodiment the hooked fingers are staggered and offset from each other with the upper hooked finger 275 insertable in the left-hand portion of the upper W-shaped opening 263 and the lower hooked finger 277 insertable in the right-hand portion of the lower W-shaped lower opening 265 (as viewed from the front of face 261).

The outer end of the intermediate support bar 269 (FIG. 10) is connected to the middle of a transverse bar 281. Transverse bar 281 extends generally horizontally and sideways.

A pair of spaced apart tire-carrying arms 283 and 285 are cantilevered and extend inwardly from the transverse bar 281 on opposite sides of the end posts 226*a* or 226*b*. The arms 283 are spaced longitudinally outward of the columns of tires 222 stacked upon the pallet 224 so as not to interfere with the load-carrying capacity of the pallet 224. Desirably, the minimum distance between each of the tire-carrying arms 283 and 285 and its associated end posts 226*a* or 226*b* is greater than the maximum radius of the tire 222 to be carried on the arms 283 and 285.

In the illustrative embodiment each of the tire-carrying arms 283 and 285 are of the same size and shape and the intermediate support arm 269, transverse bar 281, and first and second tire-carrying arms 283 and 285 are all tubular.

Preferably, each of the bracket assemblies 251 (FIG. 10) are vertically spaced from each other with the minimum vertical spacing between the tire-carrying arms 283 or 285 of adjacent bracket assemblies 251 being greater than the maximum diameter of the tires 222 to be carried on the arms 283 and 285.

Figure 12:
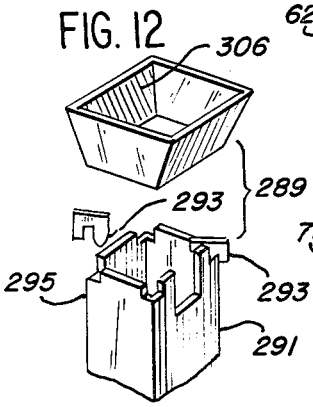
FIG. 12, shown on the second sheet of drawings, is an exploded perspective view of portions of an upper post-engaging assembly.
Figure 4:
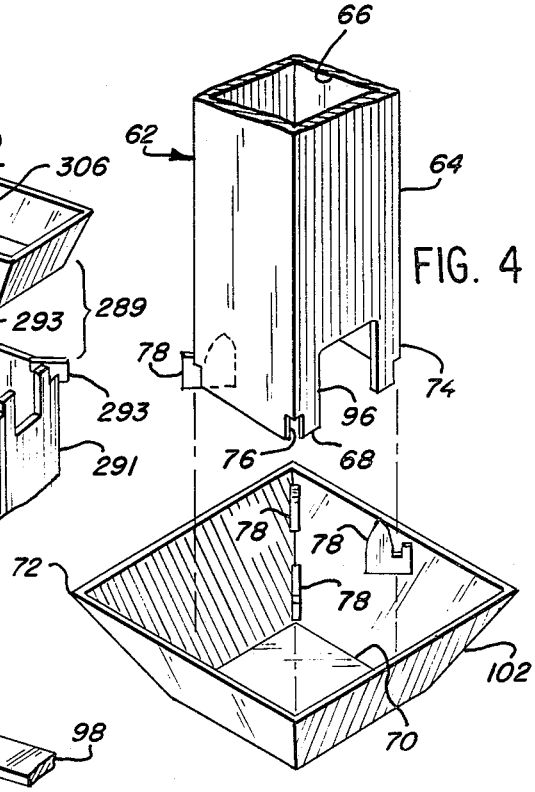
FIG. 4 is an enlarged exploded perspective view of portions of a post-supporting assembly.

In order to substantially prevent the end posts 226*a* and 226*b* from bending and deflecting under load, a horizontal beam 287 extends longitudinally between and connects the top portions of the end posts 226*a* and 226*b* so as to rigidify and reinforce the end posts 226*a* and 226*b*, as shown in FIG. 10. In the preferred construction, each of the end posts 226*a* and 226*b* has mounted on its upper end an upper post-engaging assembly 289 (FIGS. 10 and 12). Upper post-engaging assembly 289 has an upper tubular socket 291 extending downwardly from an upper truncated support member or cup 306. Upper socket 291 is preferably structurally similar and is orientated symmetrical to lower socket 264 (i.e., the upper socket 289 is inverted relative to the lower socket 264 so as to be telescopically insertable upon the top of the end post 226*a* or 226*b*). Preferably, the upper tubular socket 291 has a plurality of upper wedges 293 that are similar to the wedges 292 of the lower post-support assembly 262. Upper wedges cooperate with the interior walls of the upper socket 289 to define an upper wedge pocket for securely grasping and wedging and thereby interlockingly connecting the upper end portions of the associated end posts 226*a* or 226*b* to the upper socket 291. In the illustrative embodiment the exterior end wall 295 of the upper socket 289, facing toward the opposite end post 226*a* or 226*b*, provides a welding surface for connection of the horizontal beam 287.

For use in railway cars, the posts 226*b* of the stackable pallet assembly 220 are preferably taller and longer than the corresponding posts 26 of pallet assembly 20 shown in FIGS. 1–9.

The above detailed description has been given for ease of understanding only. No unnecessary limitations are to be understood therefrom, as modifications will be obvious to those skilled in the art.

What is claimed is:

1. A stackable pallet assembly, comprising:

a plurality of posts;

a pallet having an upper load-supporting surface;

post-supporting means carried by said pallet for rigidly supporting each of said posts;

post removal means operatively associated with said post-supporting means for facilitating removal of said posts from said post-supporting means; and at least one bracket assembly connected to one of said posts, said bracket assembly including a bracket support connected to said post, an intermediate supporting arm for extending outwardly of said bracket support, connecting means attached to one end of said intermediate support arm for removably connecting said intermediate support arm to said bracket support, a transverse bar attached to the other end of said intermediate support arm, a first load-carrying arm extending inwardly from said transverse bar on one side of said intermediate support arm and a second load-carrying arm extending inwardly from said transverse bar on the other side of said intermediate support arm.

2. A stackable pallet assembly in accordance with claim 1 wherein:

said posts include a pair of spaced end posts;

said post-supporting means include a first nestable truncated support member aligned beneath each of said end posts and extending beneath the underside of said pallet, said first nestable truncated support member having a base portion and outwardly flared side walls extending upwardly from said base portion;

a second truncated nestable support member positioned on top of each end post for nesting within the first truncated nestable support member of a corresponding post of another stackable pallet assembly to accommodate stacking of loaded pallet assemblies;

an upper socket extending downwardly from said second truncated nestable support member and telescopically insertable upon the top of said end post;

wedge means including at least one locking ear extending into the interior of said upper socket for wedgingly connecting said upper socket to said end post; and said stackable pallet assembly includes a beam secured to said upper sockets and extending between and connecting said upper sockets.

3. A stackable pallet assembly, comprising:

a plurality of posts each having a hollow portion at its bottom end;

a pallet having an upper load-supporting surface and an underside, said pallet defining a plurality of generally upwardly facing openings;

post-supporting means carried by said pallet for rigidly supporting each of said posts at generally uniform heights to provide stable uniform stacking under load conditions;

said post-supporting means for each of said posts including an elongated socket extending upwardly through one of said upwardly facing openings of said pallet for telescopically receiving said post, said socket being secured to said pallet, and wedge means extending into the interior of said socket for interlockingly and wedgingly engaging and rigidly supporting the hollow bottom end portion of said post;

said wedge means including a plurality of locking ears, each of said locking ears having an inwardly facing side and an upwardly inclined bearing surface, said upwardly inclined facing surface having an upright lower portion and an upper arcuate portion extending above said upright lower portion, said upright lower portion and said upwardly inclined bearing surface intersecting at an apex, said upwardly inclined bearing surface having an elongated lower portion defining a wedge and having an upper portion inclined inwardly of said wedge for facilitating entry of said post upon said wedge, and said wedge and said socket cooperating with each other to define a wedge pocket for wedgingly receiving said post.

4. A stackable pallet assembly in accordance with claim 3 further including at least one bracket assembly connected to one of said posts, said bracket assembly having a bracket support connected to said post, said bracket support having a front face spaced from said post, said front face defining a pair of generally W-shaped finger-receiving apertures, an intermediate supporting arm for extending outwardly of said bracket support, connection means including a generally U-shaped connector with an upright wall attached to one end of said intermediate support arm and facing said front face, said connector having a pair of hooked fingers insertable in said finger-receiving apertures for removably connecting said intermediate support arm to said bracket support, said fingers being staggered and offset from each other, a transverse bar attached to the other end of said intermediate support arm and at least one load-carrying arm extending inwardly from said transverse bar.

5. A stackable pallet assembly for carrying tires and the like, comprising:

a plurality of tubular posts each having a rectangular cross-section;

a pallet having an upper load-supporting surface including a louvered deck for supporting columns of tires, and a frame supporting said louvered deck, said frame having opposed elongated sides, ends extending between and connecting said sides, and an underside, said pallet defining a generally upwardly facing opening for each of said tubular posts;

post-supporting means for rigidly supporting each of said posts in an upright position substantially perpendicular to said upper load-supporting surface, said post-supporting means including a first nestable truncated support member positioned beneath the underside of said pallet, said nestable truncated support member having a base portion and outwardly flared side walls extending upwardly therefrom, an elongated rectangular socket extending upwardly from said base portion through said upwardly facing opening for telescopically receiving one of said posts, said rectangular socket having a lower end portion with four corners, each corner defining a locking ear-receiving slot adjacent said base portion, said rectangular socket being secured to said pallet and to said base portion, and wedge means including a plurality of locking ears secured to said base portion, with a locking ear positioned in the slot defined by each of said four corners, said locking ear having an upwardly inclined bearing surface forming a wedge disposed within the interior of said socket and projecting inwardly from its said corner towards an opposite corner for interlockingly and wedgingly engaging and rigidly supporting the bottom portion of said post.

6. A stackable pallet assembly in accordance with claim 5 wherein:

said wedge extends upwardly and inwardly, away from the socket corner with which it is associated, at an acute angle to the vertical, and said post-supporting assembly defines a wedge pocket between each of said wedges and its said associated corner for receiving the bottom portion of said post.

7. A stackable pallet assembly in accordance with claim 5 wherein the lower end portion of said socket defines an access opening facing outwardly and extending above said nestable truncated support member, and said stackable pallet assembly includes lever means insertable in said access opening for pryingly engaging and releasing the bottom edges of said post from said interlocking position to permit removal of said posts from said post-support assembly.

8. A stackable pallet assembly in accordance with claim 7 wherein said flared side walls of said first truncated support member having an upper edge portion adjacent said access opening, said edge portion providing a fulcrum for said lever means.

9. A stackable pallet assembly in accordance with claim 5 further including a second truncated nestable support member connected to the top of each post for nesting within and supporting the first truncated nestable support member of a corresponding post of another stackable pallet assembly to accommodate stacking of loaded pallet assemblies.

10. A stackable pallet assembly in accordance with claim 5 wherein:

said socket extends to a height slightly above the louvered deck, and said pallet further includes a plurality of tine-receiving and supporting guides extending downwardly from the underside of said pallet for receiving the tines of a forklift truck.

11. A stackable pallet assembly in accordance with claim 5 wherein the minimum spacing between said posts is greater than the maximum diameter of one of said tires.

12. A stackable pallet in accordance with claim 5 wherein:

there are six posts including an end post extending upwardly from each end and two side posts extending upwardly from each side, and said frame includes a plurality of transverse support angle connected to said sides for supporting said louvered deck.

13. A stackable pallet assembly for carrying tires and the like in a railway car, comprising:

a plurality of tubular posts each having a rectangular cross-section including a first end post positioned adjacent one end of said frame and a second end post positioned adjacent the other end of said frame;

a generally horizontal beam connecting the top portions of said first and second end posts for rigidifying and reinforcing said first and second end posts to substantially prevent said end posts from bending under load;

a pallet having an upper load-supporting surface for supporting columns of tires and a frame supporting said upper load-supporting surface, said frame having opposed elongated sides, ends extending between and connecting said sides and an underside, said pallet defining a generally upwardly facing opening for each of said posts;

post-supporting means for rigidly supporting said posts in an upright position substantially perpendicular to said upper load-supporting surface, said post-supporting means including a first nestable truncated support member positioned beneath the underside of said pallet, said nestable truncated support member having a base portion and outwardly flared side walls extending upwardly therefrom, an elongated rectangular socket extending upwardly from said base portion through said upwardly facing opening and secured to said pallet for telescopically receiving one of said posts, said rectangular socket having a lower end portion with four corners, each corner defining a locking ear-receiving slot adjacent said base portion, said rectangular socket being secured to said pallet and to said base portion, and wedge means including a plurality of locking ears secured to said base portion, with a locking ear positioned in the slot defined by each of said four corners, said locking ear having an upwardly inclined bearing surface forming a wedge disposed within the interior of said socket and projecting inwardly from its said corner towards an opposite corner for interlockingly and wedgingly engaging and rigidly supporting the bottom portion of said post;

three bracket assemblies extending outwardly from each end post, each bracket assembly including a bracket support connected to said post, an intermediate supporting arm for extending outwardly of said bracket support, connecting means attached to one end of said intermediate support arm for removably connecting said intermediate support arm to said bracket support, a transverse bar attached to the other end of said intermediate support arm, a first tire-carrying arm extending inwardly from said transverse bar on one side of said post and a second tire-carrying arm extending inwardly from said transverse bar on the other side of said post;

the minimum distance between each of said tire-carrying arms and said post being greater than the maximum radius of the tire to be carried on said arm; and each of the bracket assemblies being vertically spaced from each other with the minimum spacing between the tire-carrying arms of adjacent bracket assemblies being greater than the maximum diameter of the tires to be carried on said arms.

14. A stackable pallet assembly in accordance with claim 13 wherein:

said connection means has at least one finger, and said bracket support includes an apertured channel for supporting said finger.

15. A stackable pallet assembly in accordance with claim 13 further including:

a second truncated nestable support member positioned on top of each end post for nesting within the first truncated nestable support member of a corresponding post of another stackable pallet assembly to accommodate stacking of loaded pallet assemblies;

an upper socket extending downwardly from said second truncated nestable support member and telescopically insertable upon the top of said end post;

wedge means extending into the interior of said upper socket for wedgingly connecting said upper socket to said end post; and said horizontal beam secured to said upper socket.

16. A stackable pallet assembly, comprising:

a plurality of posts each having a hollow portion at its bottom end;

a pallet having an upper load-supporting surface and an underside, said pallet defining a plurality of generally upwardly facing openings;

post-supporting means carried by said pallet for rigidly supporting each of said posts at generally uniform heights to provide stable uniform stacking under load conditions;

said post-supporting means for each of said posts including an elongated socket extending upwardly through one of said upwardly facing openings for telescopically receiving said post, said socket being secured to said pallet, and wedge means extending into the interior of said socket for interlockingly and wedgingly engaging and rigidly supporting the hollow bottom end portion of said post;

said wedge means including a locking ear with an upwardly inclined bearing surface forming a wedge, said wedge defining a wedge pocket between said wedge and said socket for wedgingly receiving said post; and said socket defines a slot for receiving said locking ear.

17. A stackable pallet assembly for carrying tires and other products, comprising:

a plurality of tubular posts each having a rectangular cross-section;

a pallet having an upper load-supporting surface for supporting columns of tires and other products, said load-supporting surface including a louvered deck having louvered portions providing a louvered shaped thickness for enhancing the load-supporting strength of said pallet and having a frame supporting said louvered deck, said frame having opposed elongated sides and ends extending between and connecting said sides, and said pallet having an underside;

post-supporting means including elongated rectangular sockets secured to said pallet adjacent said louvered deck and extending upwardly for telescopically receiving and supporting said posts in an upright position, and a nestable truncated support member aligned beneath each of said posts and extending beneath the underside of said pallet, said nestable truncated support member having a base portion connected to and supporting one of said sockets and having outwardly flared side walls extending upwardly from said base portion; and said posts being removable from said sockets for lying across and being supportingly carried by said louvered deck during storage.

18. A stackable pallet assembly, comprising:

a plurality of posts;

a pallet having an upper load-supporting surface;

post-supporting means carried by said pallet for rigidly supporting each of said posts;

post removal means operatively associated with said post-supporting means for facilitating removal of said posts from said post-supporting means; and said post-supporting means for each of said posts including wedge means for wedgingly engaging said post in an upright position and at an angle relative to said upper load-supporting surface that is generally the same for all said posts, said posts each including means for receiving said wedge means, said wedge means including a plurality of locking ears, each of said locking ears having an inwardly facing side and an upwardly inclined bearing surface, said inwardly facing side having an upright lower portion and an upper arcuate portion extending above said upright lower portion, said upper arcuate portion and said upwardly inclined bearing surface intersecting at an apex, said upwardly inclined bearing surface having an elongated lower portion defining a wedge and having an upper portion tapered inwardly of said wedge for facilitating entry of said post upon said wedge.

* * * * *